US008151613B2

(12) United States Patent
Ishikura et al.

(10) Patent No.: US 8,151,613 B2
(45) Date of Patent: Apr. 10, 2012

(54) METHOD FOR SHOT PEENING

(75) Inventors: Ryohei Ishikura, Aichi (JP); Takashi Kano, Tokyo (JP); Makio Kato, Aichi (JP); Yuji Kobayashi, Toyokawa (JP); Satoru Ujihashi, Toyokawa (JP); Kiyoshi Okumura, Kitanagoya (JP)

(73) Assignee: Sintokogio, Ltd., Aichi (JP)

( * ) Notice: Subject to any disclaimer, the term of this patent is extended or adjusted under 35 U.S.C. 154(b) by 134 days.

(21) Appl. No.: 12/745,156

(22) PCT Filed: Nov. 21, 2008

(86) PCT No.: PCT/JP2008/071241

§ 371 (c)(1),
(2), (4) Date: May 27, 2010

(87) PCT Pub. No.: WO2009/069556

PCT Pub. Date: Jun. 4, 2009

(65) Prior Publication Data

US 2010/0300168 A1 Dec. 2, 2010

(30) Foreign Application Priority Data

Nov. 28, 2007 (JP) ..... 2007-308049

(51) Int. Cl.
*C21D 7/06* (2006.01)
*F16H 55/17* (2006.01)

(52) U.S. Cl. ..... 72/53; 29/90.7; 451/38

(58) Field of Classification Search ..... 72/53; 29/90.7; 451/38, 39

See application file for complete search history.

(56) References Cited

U.S. PATENT DOCUMENTS

| | | | | |
|---|---|---|---|---|
| 5,816,088 | A * | 10/1998 | Yamada et al. | 29/90.7 |
| 6,038,900 | A * | 3/2000 | Miyasaka | 72/53 |
| 7,763,123 | B2 * | 7/2010 | Suda et al. | 72/53 |
| 2008/0202183 | A1 | 8/2008 | Kobayashi | |

FOREIGN PATENT DOCUMENTS

| | | |
|---|---|---|
| JP | 9-57629 | 3/1997 |
| JP | 2001-079766 | 3/2001 |
| JP | 2002-36115 | 2/2002 |
| JP | 2006-346761 | 12/2006 |
| JP | 2008-069938 | 3/2008 |
| WO | WO 2006/134878 A1 | 12/2006 |

OTHER PUBLICATIONS

International Search Report dated Feb. 24, 2009 corresponding International Application No. PCT/JP2008/071241.

* cited by examiner

*Primary Examiner* — David Jones
(74) *Attorney, Agent, or Firm* — Finnegan, Henderson, Farabow, Garrett & Dunner, L.L.P.

(57) ABSTRACT

The object of the present invention is to provide a method for shot peening by which a compressive residual stress that is higher than any achieved by the conventional method can be achieved while the thickness of the processed material that is scraped is suppressed. The method is characterized in that the shot materials are shot against the processed material that has the hardness of 750 HV or more that is calculated from equations (1) to (3) below. The shot materials have Vickers hardness that is higher than the hardness of the processed material by 50 HV to 250 HV. The thickness of the processed material that is to be scraped is suppressed to 5 μm or less.

$$HV(m)=\{f(C)-f(T,t)\}(1-\gamma_R/100)+400\times\gamma_R/100 \quad \text{Equation (1)}$$

$$f(C)=-660C^2+1373C+278 \quad \text{Equation (2)}$$

$$f(T,t)=0.05T(\log t+17)-318 \quad \text{Equation (3)}$$

where C denotes the C (carbon) content in the surface layer that is achieved by carburizing (mass %), T denotes the tempering temperature (K), t denotes the tempering time (hr), and $\gamma_R$ denotes the amount of residual austenite (vol. %).

3 Claims, 1 Drawing Sheet

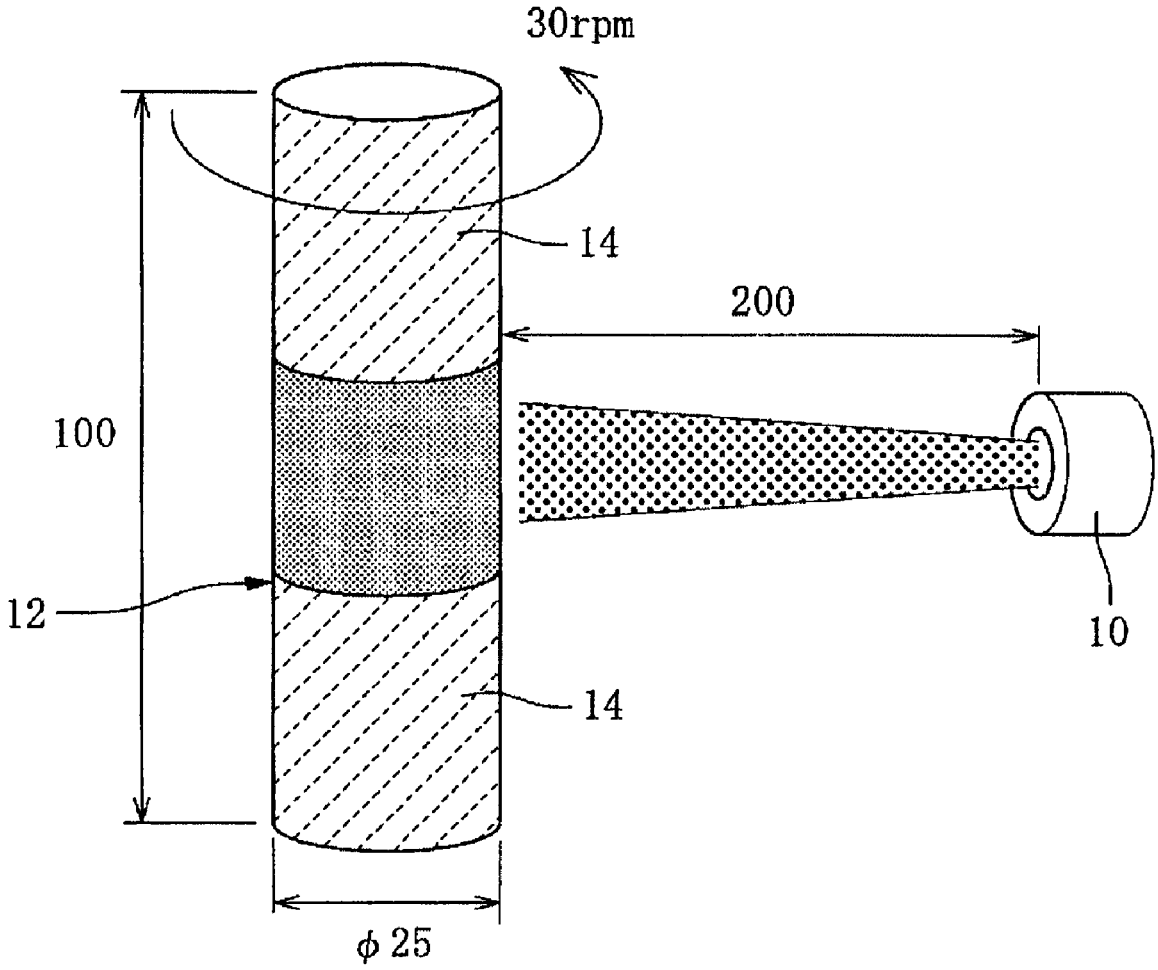
30rpm
14
200
100
12
10
14
ϕ 25

METHOD FOR SHOT PEENING

TECHNICAL FIELD

This invention relates to a method for shot peening, and more particularly to a method for shot peening by which higher compressive residual stress can be generated in a surface layer of a processed material than by conventional methods.

BACKGROUND ART

Conventionally, shot peening has been known as a useful method to enhance the fatigue strength of a high-strength steel such as a carburized steel, which is used for gears for automobiles, etc. A compressive residual stress in the surface layer that is generated by shot peening is known to significantly affect the bending fatigue strength at the root of a tooth.

It is also well known that the compressive residual stress is affected by the sizes, hardnesses, shooting speeds, shooting times, etc. of the shot materials. Many studies have been made about the effects of the shot-peening conditions on the compressive residual stress.

Recently, needs for higher-strength steels have increased as components are made smaller. Accordingly generating a higher compressive residual stress in a processed material by shot peening is required to achieve a higher fatigue strength.

For example, to achieve a higher fatigue strength by 20%, a compressive residual stress at 1800 MPa in a processed material is required when the peak compressive residual stress that is generated by current heavy shot peening is 1500 MPa.

Previously, developing harder shot materials has been the main way to achieve the higher compressive residual stress in the processed material. However, shot peening harder shot materials does not always cause the processed material to generate a higher compressive residual stress. In fact, it may adversely decrease the compressive residual stress. The hardness of the shot materials must be appropriate for the processed material.

For example, in some combinations of shot materials having a certain hardness and a processed material having a certain hardness, the processed material may be significantly scraped by the shot materials. In this case, the energy for shooting is wasted in scraping. Thus no compressive residual stress is effectively generated in the processed material.

If the shot materials have a much higher hardness than the processed material, a high compressive residual stress is generated, but much of the processed material is scraped. Thus the roughness of the surface of the processed material becomes coarse. That may create a point for initiating a fatigue fracture. Further, a large amount to be scraped may result in decreasing the size of a component.

Shot materials that have a significantly higher hardness are expensive. Even if shot materials that are expensive are used, the compressive residual stress that is generated in the processed material would not increase over a certain value. Thus, only the cost would increase.

Therefore it is important to balance the hardness of the shot materials with that of the processed material to properly generate a higher compressive residual stress in the surface layer of the processed material.

Until now no finding has been disclosed for such ways of thinking. For example, techniques to generate a compressive residual stress in a processed material by shooting the shot materials against the processed material were disclosed in Japanese Patent Laid-open Publication No. 2002-36115, Japanese Patent Laid-open Publication No. 2001-79766, and Japanese Patent Laid-open Publication No. H9-57629.

However, Japanese Patent Laid-open Publication No. 2002-36115 does not discuss scraping. Japanese Patent Laid-open Publication No. 2001-79766 does not discuss any relationship between a processed material and shot materials, nor does Japanese Patent Laid-open Publication No. H9-57629.

DISCLOSURE OF INVENTION

Based on the background as discussed above, the object of the present invention is to provide a method for shot peening by which a higher compressive residual stress is generated in the processed steel while scraping is prevented. Thus the fatigue strength is effectively enhanced by the higher compressive residual stress.

The first aspect of the present invention is characterized in that, when a hardness HV(m) of a processed steel that is calculated from equations (1) to (3) below is 750 HV or more, shot materials having a Vickers hardness that is higher than the hardness of the processed steel by 50 HV to 250 HV are shot against the processed steel. During the process the thickness of the scraped processed steel is 5 μm or less.

$$\mathrm{HV}(m)=\{f(\mathrm{C})-f(T,t)\}(1-\gamma_R/100)+400\times\gamma_R/100 \quad \text{Equation (1)}$$

$$f(\mathrm{C})=-660\mathrm{C}^2+1373\mathrm{C}+278 \quad \text{Equation (2)}$$

$$f(T,t)=0.05T(\log t+17)-318 \quad \text{Equation (3)}$$

where C denotes the C (carbon) content in a surface layer that is achieved by carburizing (mass %), T the tempering temperature (K), t the holding time for tempering (hr), and $\gamma_R$ the amount of residual austenite (vol. %). The value HV(m) is calculated from equation (1). It represents an estimation of the Vickers hardness. It is equivalent to the value of the Vickers hardness. Thus the letters HV are added to the value.

The second aspect of the present invention is characterized in that, in the first aspect, the C content of the surface layer is within the range of 0.60 to 1.0%.

The third aspect of the present invention is characterized in that, in the first or second aspect, the sizes of the shot materials are within the range of 0.05 to 0.6 mm in diameter and the shot materials are shot against the processed steel by air at a pressure of 0.4 to 0.6 MPa.

The sizes of the shot materials are typically measured by the method for measuring grain sizes as stipulated in the Japanese Industrial Standards by JIS G5904.

As discussed above, the present invention is to generate a compressive residual stress in a surface layer of a processed steel by making the hardness HV(m) of the processed steel 750 HV or more. This hardness is calculated from equations (1) to (3). The compressive stress is generated by shooting shot materials having a Vickers hardness that is higher than the hardness of the processed steel by 50 HV to 250 HV while the thickness of the scraped processed steel is 5 μm or less. By the present invention, a compressive residual stress such as 1800 MPa or more, which is higher than that in conventional steel, can be generated in the processed steel. Thus the fatigue strength of a high-strength component, such as a gear of an automobile, can be effectively increased.

If the hardness HV(m) of the processed steel is less than 750 HV, sufficient compressive residual stress is not generated in the surface layer of the processed steel by shot peening.

The maximum limit to generate a compressive residual stress is almost equal to the yield strength (approximately 0.2% proof stress) of the processed steel. The yield strength is proportional to the hardness of the steel.

Thus if the hardness HV(m) of the steel is less than 750 HV, the maximum limit of the compressive residual stress is lowered. Thus a sufficiently higher compressive residual stress cannot be generated.

Therefore, the hardness HV(m) of the processed steel must be 750 HV or more.

It is important that the Vickers hardness HV of the shot materials be higher than the hardness HV(m) of the processed steel.

If the Vickers hardness HV of the shot materials is lower than the hardness HV(m) of the processed steel, the shot materials undergo plastic deformation (yield). Thus sufficient energy to generate a compressive residual stress cannot be transferred to the processed steel. Further, the life of the shot materials is shortened.

Especially to be noted, it was found that the Vickers hardness of the shot materials must be higher than the hardness HV(m) of the processed steel by 50 HV or more to generate a higher compressive residual stress in the processed steel.

In contrast, if the Vickers hardness of the shot materials is higher than the hardness HV(m) of the processed steel by 250 HV or more, the energy of the shot materials used to scrape the processed steel is wasted. Thus no higher compressive residual stress is effectively or stably generated.

Even if a higher compressive residual stress is generated in the processed steel, a large amount is scraped from its surface layer due to the excessively high hardness of the shot materials. Thus the size of the high-strength component may deviate from the specification. Further, the large amount to be scraped causes the surface roughness to be coarse. That may create a point for initiating a fatigue fracture.

Even if a higher compressive residual stress is generated, it cannot increase over a certain value. That is, it does not increase as the hardness of the shot materials increases. But, instead, it gradually reaches a certain value.

Further, the shot materials that have a much higher hardness are expensive. Thus the cost for the treatment becomes higher.

For this reason, it is important that the difference between the hardness HV(m) of the processed steel and the Vickers hardness HV of the shot materials be limited to 250 HV or less.

In the present invention the thickness to be scraped from the processed material is limited to 5 μm. If the thickness exceeds that limit, the energy of the shot materials is wasted for scraping. Thus it is not effectively used to generate the compressive residual stress. Further, a large thickness to be scraped causes the size of the high-strength component to decrease, to thereby lower its quality.

The hardness HV(m) of the processed steel as in the specification is the hardness of the surface layer of the steel after carburizing and at a depth of 0.050 mm or less from the surface. That is, the hardness HV(m) of the processed steel, which is calculated from equations (1) to (3), represents the hardness of the surface layer where the depth is 0.050 mm or less.

In the present invention the hardness HV(m) of the processed steel is calculated by equations (1) to (3). By doing so the hardness HV(m) of 750 HV can be maintained by controlling the conditions of carburizing, etc. The hardness is estimated from a non-destructive test and corresponds to the Vickers hardness.

The first portion of equation (1), $\{f(C)-f(T,t)\}(1-\gamma_R/100)$, represents contribution of tempered martensite to the hardness. The second portion of equation (1), $400\times\gamma_R/100$, represents the contribution of residual austenite to the hardness.

The martensitic transformation of the processed steel cannot be completed by cooling the material to room temperature. Thus it has a structure that is a combination of a quenched structure (martensite) and residual austenite that has not been transformed.

Therefore the estimate of the hardness HV(m) of the processed steel must be based on these two structures. The part $\{f(C)-f(T,t)\}$ of the first portion of equation (1) represents the hardness of the martensite after tempering. The term f(C) denotes the hardness of the martensite before tempering. The term f(T, t) denotes the reduction of the hardness by tempering. The part $(1-\gamma_R/100)$ represents the ratio of the volume of the martensite.

The term f(C) is expressed as equation (2), i.e., $f(C)=-660C^2+1373C+278$. This equation is obtained by approximating by a quadratic curve the relationship between the carbon content of the martensite and its hardness. To obtain the equation various kinds of martensite that have different carbon contents are used.

Quenching conditions are determined by the tempering temperature and tempering time. Thus the reduction of hardness f(T, t) by tempering is expressed by an approximation (by Hollomon, et al.), $0.05T(\log t+17)-318$, which uses the tempering temperature T and the tempering time t.

The value 400 of the second portion of equation 1 denotes the hardness (Vickers hardness) of the residual austenite.

In the second aspect of the present invention, the C content of the surface layer is kept within the range of 0.60% to 1.0%. Thereby the conditions of the first aspect are maintained.

If the C content is less than 0.60%, the hardness of the processed steel is lower due to the low C content. Thus it may be difficult to maintain the hardness to comply with the conditions of the first aspect.

In contrast, if the C content exceeds 1.0%, there will be too much residual austenite. That results in the decrease of the hardness of the processed steel. Thus it may be difficult to maintain the hardness to comply with the conditions of the first aspect. Further, if the C content is excessive, much carbide is deposited at the grain boundaries. That may cause a deterioration of the fatigue strength.

The C content is preferably kept in the range of 0.60% to 0.85%. If it exceeds 0.85%, the hardness of the processed steel starts to decrease because of too much residual austenite. However, when the steel is subject to a subzero treatment, i.e., where it is cooled to a temperature (e.g., −80° C.) much lower than room temperature, the residual austenite is transformed to the martensite. Thus the ratio of the volume of the residual austenite, which is 10 to 40 vol. %, is reduced to 5 to 15 vol. %. As a result the hardness of the processed steel can be improved.

Carburizing is preferably carried out as vacuum eutectoid carburizing.

In gas carburizing, an abnormally carburized layer, which is a soft layer caused by the oxidization of the surface (deteriorated ability to quench due to oxidization at the grain boundaries), may be created to lower the hardness of the processed steel. Thus it is difficult to maintain the hardness of the processed steel to comply with the conditions of the first aspect. However, even for gas carburizing, it is possible to have the hardness of the processed steel comply with the conditions, either by using a material that has a good ability to quench or by removing the abnormally carburized layer after quenching (before shot peening).

In the third aspect of the present invention, shot materials that are 0.05 to 0.6 mm in diameter are used. They are shot against the processed steel by air at a pressure of 0.4 to 0.6 MPa.

If the shot materials are less than 0.05 mm in diameter, it is difficult to manufacture them. If they are greater than 0.6 mm, the peak of the compressive residual stress occurs at a deeper point. Thus the distribution of the compressive residual stress is not effective to enhance the fatigue strength. The peak preferably occurs at 100 μm or less from the surface, so as to enhance the fatigue strength.

If the air pressure is less than 0.4 MPa, the intensity of the shot peening decreases. Thus it may be difficult to generate a high compressive residual stress such as 1800 MPa or more.

In contrast, if it is greater than 0.6 MPa, the intensity may be excessive. Thus much of the processed steel may be scraped. Further, it is difficult to compress air at the pressure of 0.6 MPa or more by the ordinary shot-peening machine.

The basic Japanese Patent Application, No. 2007-308049, filed Nov. 28, 2007, is hereby incorporated by reference in its entirety in the present application.

The present invention will become more fully understood from the detailed description given below. However, the detailed description and the specific embodiment are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Below an embodiment of the present invention is discussed in detail.

Steel having the chemical composition as listed in Table 1 is used to prepare a processed material. The steel is SCM420H (chromium-molybdenum steel), as specified by JIS G 4502. The middle line of Table 1 shows the range of the chemical composition for SCM420H. The bottom line shows the chemical composition of the material that is used for the processed material. The raw material of the steel is machined into a steel bar that is 25 mm in diameter×100 mm long. The bar is carburized and processed by shot peening under the conditions listed in Tables 2 and 3. Then, the thicknesses of scraped processed materials and the peak values of compressive residual stresses are measured. The process for shot peening is discussed below.

TABLE 1

| | Chemical Composition (mass %) | | | | | | | | |
|---|---|---|---|---|---|---|---|---|---|
| Steel | C | Si | Mn | P | S | Ni | Cr | Mo | Fe |
| SCM420H | 0.17-0.23 | 0.15-0.35 | 0.55-0.95 | 0.030 or less | 0.030 or less | 0.25 or less | 0.85-1.25 | 0.15-0.30 | Remainder |
| Material Used | 0.19 | 0.20 | 0.72 | 0.025 | 0.018 | 0.11 | 1.10 | 0.16 | Remainder |

<Method for Shot Peening>

As shown in FIG. 1, an air-type shot-peening machine, which has an injection nozzle 10, is used to process a material 12 by shot peening.

The material 12 to be processed is located at 200 mm from the injection nozzle 10. It is placed so that its surface to be processed is perpendicular to the angle for shooting the shot materials.

While the material 12 is rotated on a turntable at 30 rpm (one rotation per two seconds), its surface is processed by shot peening.

The time for shot peening is set so that the coverage of the surface by the shot peening is 300%. The shot materials have diameters of 0.05 to 0.6 mm and a Vickers hardnesses of 700 HV to 1380 HV. The air pressure for the shot peening is within the range of 0.3 to 0.6 MPa.

The number "14" in FIG. 1 denotes a masking material.

Using the processed materials that are prepared as above, the thicknesses of scraped materials and the peak values of the residual compressive stresses are measured as below.

<Method for Measuring Thickness of Scraped Material>

The diameters of the processed materials 12 both before shot peening and after shot peening are measured by using a laser-type dimension-measuring device. The thickness of the scraped material is calculated by the following equation. The thickness is the mean value of ten measurements (n=10). The positions used for the measurements are the centers of areas against which the shot materials are shot (the positions where the maximum thicknesses of scraped materials occur).

$$\text{The thickness of scraped material}=(D1-D2)/2,$$

where D1 denotes the diameter of the processed material before shot peening, and D2 denotes the diameter of the processed material after shot peening.

<Method for Measuring Compressive Residual Stress>

An X-ray stress measuring method, which is a common method for a non-destructive test, and specified by JIS B 2711, is used to measure the compressive residual stresses of the processed materials after shot peening.

Since the samples have martensitic structures, the residual stresses are measured by using CrKα radiation as X-rays and −318 MPa/° as the stress constant k. The positions for the measurements are the centers of the areas against which the shot materials are shot.

The peak (maximum value) of the compressive residual stress is measured by electropolishing the processed material to a determined thickness in an area that is approximately double the sectional area of an incident x-ray beam and by measuring the stress distribution.

The carbon content and the percentages of residual austenite at the surface layers in FIGS. 2 and 3 are measured as below.

<Method for Measuring Carbon Content at Surface Layer>

The carbon content in the surface layers is measured by using dummy specimens (20 mm in diameter×5 mm thick) that are placed with the processed materials to be carburized to prevent a sample (the processed material 12) from being fractured. The carbon content is measured by luminescence spectrophotometry. It is measured on the flat surfaces of the dummy specimens. The number of measurements are set as two (n=2). The principle of the measurements is to evaporate and excite a target element (C) in a specimen by discharge plasma to measure the wavelengths of the characteristic atomic spectrum of the target element. Then the carbon content is determined by the intensity of the luminescence.

<Method for Measuring Amount of Residual Austenite>

The amount of residual austenite ($\gamma_R$) is non-destructively measured in a surface layer (a depth of tens of microns or less) by the X-ray diffraction method.

The principle of the measurements is to measure $\gamma_R\{220\}$ by X-ray diffraction. By comparing martensite $\alpha'\{211\}$ to the integration of the diffraction line profile, the volume percentage of residual austenite is obtained.

The results of the measurements are shown in Tables 2 and 3.

TABLE 2

Working Examples

| No | Steel | Heat Treatment | C % in Surface Layer | Ratio of Area of Carbide | Sub zero | Resid. γ (%) | Tempering Temp. [° C.] | Tempering Time [min] | Hardness of Processed Material HV(m) |
|---|---|---|---|---|---|---|---|---|---|
| 1 | SCM 420H | Vacuum Eutectoid Carburizing | 0.79 | — | — | 25.00 | 150 | 60 | 782 |
| 2 | | | 0.72 | — | — | 24.80 | 150 | 60 | 763 |
| 3 | | | 0.79 | — | — | 25.00 | 150 | 60 | 782 |
| 4 | | | 0.70 | — | — | 21.18 | 150 | 60 | 774 |
| 5 | | | 0.72 | — | — | 24.80 | 150 | 60 | 763 |
| 6 | | | 0.75 | — | — | 21.40 | 140 | 120 | 791 |
| 7 | | | 0.80 | — | — | 21.64 | 140 | 120 | 803 |
| 8 | | | 0.78 | — | Yes | 8.55 | 140 | 120 | 865 |
| 9 | | | 0.85 | — | — | 25.77 | 180 | 60 | 772 |
| 10 | | | 0.85 | — | Yes | 8.26 | 180 | 60 | 860 |
| 11 | | | 1.03 | — | Yes | 15.30 | 180 | 60 | 845 |
| 12 | | | 0.75 | — | — | 21.40 | 140 | 120 | 791 |
| 13 | | | 0.75 | — | — | 21.40 | 140 | 120 | 791 |
| 14 | | Gas Carburizing (Remove Abnormal Layer) | 0.75 | — | — | 18.50 | 180 | 60 | 783 |

| | Conditions of shot | | | Shot Materials - | After Shot-Peening | |
|---|---|---|---|---|---|---|
| No | Hardness of Shot Materials [HV] | Size of Shot Materials [mm] | Air Pressure [MPa] | Processed Materials (Hardness HV) | Thickness Scraped (μm) | Peak of Comp. Resid. Stress [MPa] |
| 1 | 850 | 0.05 | 0.5 | 68 | 0.0 | 1869 |
| 2 | 900 | 0.05 | 0.5 | 137 | 0.0 | 1994 |
| 3 | 900 | 0.1 | 0.5 | 118 | 0.0 | 1813 |
| 4 | 900 | 0.3 | 0.5 | 126 | 0.0 | 2049 |
| 5 | 950 | 0.3 | 0.5 | 187 | 0.0 | 2041 |
| 6 | 950 | 0.6 | 0.5 | 159 | 0.0 | 2030 |
| 7 | 950 | 0.3 | 0.5 | 147 | 0.0 | 1939 |
| 8 | 950 | 0.3 | 0.5 | 85 | 0.0 | 2016 |
| 9 | 950 | 0.3 | 0.5 | 178 | 0.0 | 1916 |
| 10 | 950 | 0.3 | 0.5 | 90 | 0.0 | 1977 |
| 11 | 950 | 0.3 | 0.5 | 105 | 0.0 | 2157 |
| 12 | 950 | 0.6 | 0.4 | 159 | 0.0 | 1925 |
| 13 | 950 | 0.6 | 0.6 | 159 | 0.0 | 2135 |
| 14 | 950 | 0.3 | 0.5 | 167 | 0.0 | 1850 |

TABLE 3

Comparative Examples

| No | Steel | Heat Treatment | C % in Surface Layer | Ratio of Area of Carbide | Sub zero | Resid. γ (%) | Tempering Temp. [° C.] | Tempering Time [min] | Hardness of Processed Material HV(m) |
|---|---|---|---|---|---|---|---|---|---|
| 1 | SCM 420H | Vacuum Eutectoid Carburizing | 0.51 | — | — | 16.91 | 180 | 60 | 682 |
| 2 | | | 0.72 | — | — | 24.80 | 150 | 60 | 763 |
| 3 | | | 0.75 | — | — | 21.40 | 140 | 120 | 791 |
| 4 | | Gas Carburizing | 0.71 | — | — | 26.06 | 180 | 60 | 735 |
| 5 | | Vacuum | 0.76 | — | — | 26.50 | 180 | 60 | 748 |
| 6 | | Eutectoid | 0.51 | — | — | 16.91 | 180 | 60 | 682 |

TABLE 3-continued

| Comparative Examples | | | | | | | | |
|---|---|---|---|---|---|---|---|---|
| 7 | Carburizing | 1.03 | — | — | 41.01 | 180 | 60 | 710 |
| 8 | Super Carburizing | 1.93 | 19.4 | — | 26.11 | 180 | 60 | 402 |
| 9 | Vacuum | 0.51 | — | — | 16.91 | 180 | 60 | 682 |
| 10 | Eutectoid | 0.72 | — | — | 24.80 | 150 | 60 | 763 |
| 11 | Carburizing | 0.79 | — | — | 25.00 | 150 | 60 | 782 |
| 12 | | 0.72 | — | — | 24.80 | 150 | 60 | 763 |
| 13 | | 0.70 | — | — | 21.18 | 150 | 60 | 774 |

| | Conditions of shot | | | Shot Materials - | After Shot-Peening | |
|---|---|---|---|---|---|---|
| No | Hardness of Shot Materials [HV] | Size of Shot Materials [mm] | Air Pressure [MPa] | Processed Materials (Hardness HV) | Thickness Scraped (μm) | Peak of Comp. Resid. Stress [MPa] |
| 1 | 700 | 0.6 | 0.3 | 18 | 0.0 | 1400 |
| 2 | 700 | 0.6 | 0.3 | 63 | 1.2 | 1074 |
| 3 | 700 | 0.6 | 0.5 | 91 | 0.0 | 1490 |
| 4 | 950 | 0.3 | 0.5 | 215 | 4.7 | 1580 |
| 5 | 950 | 0.3 | 0.5 | 202 | 0.0 | 1724 |
| 6 | 950 | 0.3 | 0.5 | 268 | 6.0 | 1545 |
| 7 | 950 | 0.3 | 0.5 | 240 | 0.0 | 1757 |
| 8 | 950 | 0.3 | 0.5 | 548 | 0.0 | 1590 |
| 9 | 900 | 0.05 | 0.5 | 218 | 9.4 | 1616 |
| 10 | 1380 | 0.1 | 0.3 | 617 | 9.6 | 1582 |
| 11 | 1380 | 0.1 | 0.5 | 598 | 76.5 | 2073 |
| 12 | 1380 | 0.2 | 0.5 | 617 | 81.7 | 1929 |
| 13 | 1200 | 0.3 | 0.5 | 426 | 163.9 | 1925 |

In Table 3 comparative example No. 1 shows that the hardness HV(m) of the processed material is 682 HV, which is lower than the minimum limit, 750 HV, for the present invention. Further, the difference between the hardness of the processed material and that of the shot materials is small. Thus the compressive residual stress does not reach the targeted stress, 1800 HV or more.

Comparative example No. 1 shows that the C % in the surface layer is 0.51%, which does not comply with the requirement for the second aspect. That causes the hardness HV(m) of the processed material to be low.

Further, comparative example No. 1 shows that the air pressure for shot peening is 0.3 MPa, which does not comply with the requirement for the third aspect. These conditions result in the lower compressive residual stress.

Comparative example No. 2 shows that the hardness HV(m) of the processed material complies with the requirements of the present invention. However the Vickers hardness HV of the shot materials is lower than the hardness of the processed material. Thus the compressive residual stress is low.

The example shows that the requirement for the third aspect is not complied with.

Comparative example No. 3 shows that the Vickers hardness HV of the shot materials is lower than the hardness HV(m) of the processed material. Thus the target for the compressive residual stress, which is 1800 MPa or more, is not achieved.

Comparative example No. 4 shows that the hardness HV(m) of the processed material is 735 HV, which is lower than the minimum limit, 750 HV, for the present invention. Thus the compressive residual stress does not reach the targeted stress, 1800 HV or more.

Since the specimen for the example has been gas-carburized, its hardness HV(m) of the processed material is low due to an abnormally carburized layer.

Comparative example No. 5 shows that the hardness HV(m) of the processed material is lower than the minimum limit for the present invention. Thus the compressive residual stress does not reach the targeted stress.

Comparative example No. 6 shows that the hardness HV(m) of the processed material is low and that the compressive residual stress does not reach the targeted stress.

Further, the example shows that the difference between the Vickers hardness HV of the shot materials and the hardness HV(m) of the processed material is 268 HV, which is greater than the upper limit for the present invention. Thus the thickness of the processed material to be scraped is large, and exceeds 5 μm.

Comparative example No. 7 shows that the hardness HV(m) of the processed material is low and that the compressive residual stress is also low.

The example also shows that the C % in the surface layer is 1.03%, which does not comply with the requirement for the second aspect. The percentage of residual austenite is as high as 41%. This high percentage causes the hardness HV(m) of the processed material to be decreased.

Comparative example No. 8 shows that the hardness HV(m) of the processed material is low and that the compressive residual stress is also low.

Since the specimen for the example has been super-carburized (carburized to a higher C content), the hardness of the matrix is low due to carbide precipitation.

Comparative example No. 9 shows that the hardness HV(m) of the processed material is low and that the thickness of the processed materials that is scraped exceeds 5 μm. It also shows that the compressive residual stress is low.

Further, it shows that the C % in the surface layer is lower than the minimum limit for the second aspect. That causes the hardness HV(m) of the processed material to be low.

Comparative example No. 10 shows that the hardness HV(m) of the processed material complies with the requirement of the present invention. But the Vickers hardness HV of the shot materials is extremely high. Thus the difference between the hardness HV of the shot materials and the hardness HV(m) of the processed material is much higher than the upper limit. Therefore the compressive residual stress does not reach the targeted stress. Further, the thickness of the processed material that is scraped becomes great. This example also shows that the air pressure for shooting the shot materials does not comply with the requirement for the third aspect.

Comparative example No. 11 shows that the Vickers hardness HV of the shot materials is extremely high. Though the compressive residual stress reaches the targeted stress, i.e., 1800 MPa, the thickness of the processed material that is scraped becomes great.

Comparative example No. 12 also shows that the Vickers hardness HV of the shot materials is high. Thus the thickness of the processed material that is scraped becomes as great as it is for comparative example No. 11.

Comparative example No. 13 also shows that the Vickers hardness HV of the shot materials is high. Since the difference between the hardness HV of the shot materials and the hardness HV(m) of the processed material exceeds the upper limit for the present invention, the thickness of the processed material that is scraped becomes great.

In contrast, all of working examples Nos. 1 to 14 show that the requirements of the present invention are complied with. Thus the compressive residual stresses are greater than the targeted stress, which is 1800 MPa.

Working examples Nos. 1 to 7 show that the hardnesses HV(m) of the processed materials are high because of low-temperature tempering.

Working example No. 8 shows that the hardness of the processed material becomes high because of low-temperature tempering in addition to the subzero treatment.

Working example No. 9 shows that the hardness HV(m) of the processed material becomes high because the C content in the surface layer is appropriately adjusted. For working example No. 10, the hardness HV(m) becomes higher because of the subzero treatment in addition to the adjustment of the C content.

Working example No. 11 shows that the hardness HV(m) of the processed material becomes high because of the subzero treatment in addition to the high C content in the surface layer.

The subzero treatment is carried out by placing a specimen in an atmosphere at −85° C. for 120 min.

The above description of the embodiment is just an example. Various possible changes to the present invention can be conceived within the scope of the present invention.

BRIEF DESCRIPTION OF DRAWINGS

FIG. 1 is an explanatory drawing of the method for shot peening by an embodiment of the present invention.

The invention claimed is:

1. A method for shot peening comprising shooting shot material against a processed material, wherein a hardness HV(m) of the processed material is calculated from equations (1), (2), and (3) and is 750 HV or more, wherein a Vickers hardness of the shot material is higher than the hardness of the processed material by 50 HV to 250 HV, and wherein a thickness of the processed material that is peened is 5 μm or less, $$HV(m)=\{f(C)-f(T,t)\}(1-\gamma_R/100)+400\times\gamma_R/100 \quad \text{Equation (1)}$$

$$f(C)=-660C^2+1373C+278 \quad \text{Equation (2)}$$

$$f(T,t)=0.05T(\log t+17)-318 \quad \text{Equation (3)}$$

where C denotes a C (carbon) content in a surface layer that is achieved by carburizing (mass %), T denotes a tempering temperature (K), t denotes a tempering time (hr), and $\gamma_R$ denotes an amount of residual austenite (vol. %).

2. The method for shot peening of claim 1, wherein the C content is within a range of 0.60% to 1.0%.

3. The method for shot peening of claim 1 or 2, wherein sizes of the shot material is within a range of 0.05 mm to 0.6 mm in diameter, and wherein the shot material is shot against the processed material by air at a pressure of 0.4 to 0.6 MPa.

* * * * *